United States Patent [19]

Claassens et al.

[11] Patent Number: 4,755,710

[45] Date of Patent: Jul. 5, 1988

[54] HIGH-PRESSURE SODIUM DISCHARGE LAMP HAVING REDUCED LAMP VOLTAGE INCREASE

[75] Inventors: Jacobus M. M. Claassens; Gerardus M. J. F. Luijks, both of Eindhoven, Netherlands

[73] Assignee: U.S. Philips Corporation, New York, N.Y.

[21] Appl. No.: 870,273

[22] Filed: Jun. 3, 1986

[30] Foreign Application Priority Data

Jun. 5, 1985 [NL] Netherlands ..... 8501615

[51] Int. Cl.[4] ..... H01J 61/28; H01J 61/34

[52] U.S. Cl. ..... 313/25; 313/546; 313/551; 313/552

[58] Field of Search ..... 313/25, 545, 546, 547, 313/551, 552, 563, 595, 601, 576, 634, 636, 643

[56] References Cited

U.S. PATENT DOCUMENTS 3,721,846 3/1973 Cohen ..... 313/15

3,932,781 1/1976 Peeters et al. ..... 313/25

FOREIGN PATENT DOCUMENTS 173217 3/1986 European Pat. Off. ..... 313/547

*Primary Examiner*—David K. Moore

*Assistant Examiner*—K. Wieder

*Attorney, Agent, or Firm*—Algy Tamoshunas; Brian J. Wieghaus; Emmanuel J. Lobato

[57] ABSTRACT

The invention relates to a high-pressure sodium discharge lamp intended to be operated in conjunction with an external starter or with an internal starter without a glow discharge. The lamp has an outer bulb which is provided with a lamp cap and encloses an evacuated space in which a discharge vessel is arranged. According to the invention, the space enclosed by the outer bulb further accommodates a closed holder, whose wall mainly comprises glass-forming constituents and which contains at least helium. Thus, it is achieved that the lamp has a strongly reduced increase in lamp voltage during the life.

23 Claims, 1 Drawing Sheet

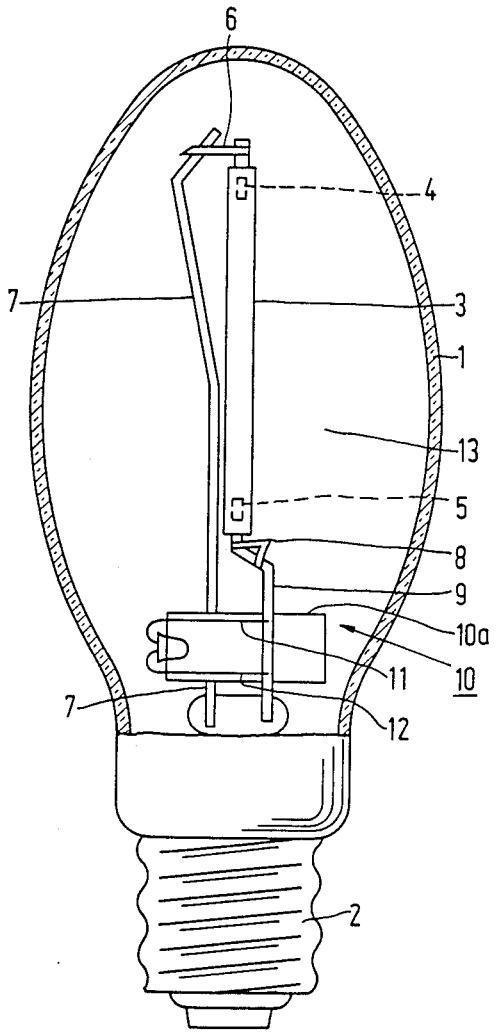
6
4
7
3
1
13
5
8
9
10a
10
11
7
12
2

HIGH-PRESSURE SODIUM DISCHARGE LAMP HAVING REDUCED LAMP VOLTAGE INCREASE

BACKGROUND OF THE INVENTION

The invention relates to a high-pressure sodium discharge lamp intended to be operated in conjunction with an internal starter without a glow discharge or with an external starter, this lamp having an outer bulb or envelope which is provided with a lamp cap and encloses an evacuated space in which a discharge vessel is arranged.

A lamp of the aforementioned kind is known, for example, from European Patent Application No. 0 132 88 to which U.S. Pat. No. 4,620,131 corresponds. This kind of lamp is frequently used inter alia in public illumination because of its high luminous efficacy, its comparatively long life and the agreeable colour of the emitted visible radiation.

The discharge vessel of the lamp is generally made of a ceramic metal oxide, such as, for example, polycrystalline densely sintered aluminium oxide or monocrystalline sapphire. The discharge vessel has as a filling constituent sodium amalgam, which is generally dosed in excess quantity. In the lamps with excess quantity dosed the vapour pressure is determined in the operating condition of the lamp by the temperature of the excess of condensate, generally known as the coldest spot temperature.

High-pressure sodium discharge lamps have a high ignition voltage, as a result of which the lamps are operated in practice in conjunction with a starter. The lamp according to the invention is intended to be operated in conjunction with an internal starter without a glow discharge or with an external starter. The term "external starter" is to be understood in this description to mean a starter which is spatially separated from the evacuated space enclosed by the outer bulb, in contrast with the lamps in which a starter is arranged in the evacuated space enclosed by the outer bulb. The external starter may then in principle be arranged in an arbitrary position with respect to the lamp, for example in a luminaire in which the lamp is mounted or in a post to which the luminaire is secured. A further possibility consists in that the starter is arranged in the lamp cap.

It has been found in practice that in the known lamp the lamp voltage exhibits in the course of the life of the lamp after mostly an initial decrease a continuous increase. For lamps operated with alternating voltage, this also leads to an increase of the reignition voltage after each change of polarity of the supply voltage. The continuous increase of the lamp voltage and of the reignition voltage results in the lamp being extinguished and hence the end of the life of the lamp being reached. In general, a decrease of lamp voltage leads to a decrease of power and to a decrease of the lumious flux of the lamp.

SUMMARY OF THE INVENTION

The invention has for its object to provide a means for reducing the continuous increase of lamp voltage during the life of the lamp. The invention further has for its object to lengthen the life of the lamp and without increasing as far as possible the variation of the lamp efficiency during the life of the lamp.

According to the invention, a lamp of the kind mentioned in the opening paragraph is characterized for this purpose in that the space enclosed by the outer bulb also accommodates a closed holder or cell, which contains at least helium and whose wall mainly comprises glass-forming constituents. The term "glass forming constituents" is to be understood herein to mean substances $SiO_2$, $B_2O_3$ and $P_2O_5$ alone or in combination.

The lamp according to the invention is found to exhibit a continuous increase of the lamp voltage, which is significantly reduced with respect to the known lamp. As far as the life of the lamp is limited by the increase of the lamp voltage, the latter is lengthened in the lamp according to the invention. The efficiency of the lamp according to the invention is found to be comparable with that of the known lamp.

The invention can be explained as follows. During the life of the known lamp, the thermal management is found to vary, also due to the influence of blackening of the ends of the discharge vessel, as a result of which the coldest spot temperature increases. An increase of the coldest spot temperature results in an increase of lamp voltage.

A method of influencing the thermal management in such a manner that the heat dissipation of the discharge vessel is increased, which results in a decrease of the coldest spot temperature, consists in reducing the vacuum around the discharge vessel. This is known per se. for example, from U.S. Pat. No. 3,932,781. In this case, heat dissipation is obtained by heat conduction throughout the surface of the discharge vessel. However, this generally influences the efficiency of the lamp. In this known method of influencing the thermal management, an influence is exerted which is the same during the whole life of the lamp. On the other hand, the increase of lamp voltage ascertained is a phenomenon which increases with time.

It is known that helium can diffuse through quartz and glass under the influence of temperature. It is a surprise to find that a closed holder containing helium and having a wall comprising for the major part glass-forming constituents in the operating condition of a high-pressure sodium discharge lamp, when this holder is arranged in the evacuated space enclosed by the outer bulb, to such a temperature that the helium diffuses to such an extent into the enclosed space that the increase of the lamp voltage is considerably reduced. Although due to the diffusion of helium the initial decrease of the lamp voltage can be slightly enlarged, this is found to have only little influence on the lamp efficiency.

Preferably, the closed holder is arranged near one end of the discharge vessel. This affords the advantage that the closed holder intercepts a minimum part of the emitted visible radiation and reaches a sufficiently high temperature.

In a preferred embodiment of the lamp according to the invention, the wall of the closed holder comprises a molar fraction of glass-forming constituents which is at least 65 and at most 90. With a molar fraction higher than 90, helium diffusion occurs in practice at such a speed that initially the influence of the voltage decrease is considerably larger than the increase of lamp voltage to be counteracted. This results in an initial strong decrease of the lamp efficiency, which is unacceptable.

A molar fraction smaller than 65 results in that the helium diffusion proceeds at such a low speed that a continuous increase of the lamp voltage can be only effectively counteracted by the use of a large surface of the closed holder.

In an advantageous embodiment, the following relation holds for the closed holder:

$$2.5\ 10^5 \leqq O/V \cdot d \leqq 10^6,$$

where O is the area of the outer surface pervious to helium of the closed holder in $m^2$, V is the volume enclosed by the closed holder in $m^3$ and d is the thickness of the wall of the closed holder in m. If the relation O V·d has a value larger than $10^6$, the helium is found to diffuse so rapidly through the wall of the closed holder that with a life of about 2000 operating hours this may lead to a decrease of efficiency of the lamp of about 10% or more as compared with a known lamp with the same life.

The case where the value of the said relation is smaller than 2.5 $10^5$ has the disadvantage that helium diffusion is so small that the influence on the heat dissipation and hence the suppression of a continuous increase of the lamp voltage can be neglected unless special steps are taken, such as very high filling pressure of the helium or additional heating of the closed holder.

In a further advantageous embodiment, the following relation holds for the lamp:

$$24 \leqq V/V_b \cdot P \leqq 94,$$

where

V is the volume enclosed by the closed holder in $m^3$;

$V_b$ is the volume of the space enclosed by the outer bulb in $m^3$ and

P is the filling pressure of the helium in the closed holder at 300K in Pa.

It holds also in this relation that if the value of the relation is larger than 94 the helium diffusion proceeds at such a high speed that this initially leads to a considerable decrease of efficiency of the lamp. At a value of the relation smaller than 24, additional steps, such as, for example, additional heating or reduction of the wall thickness, prove to be necessary in order to obtain an effective reduction of the increase of the lamp voltage.

DETAILED DESCRIPTION OF THE INVENTION

A lamp according to the invention will be described more fully by way of example, with reference to a drawing.

An outer bulb 1 of a high-pressure sodium discharge lamp is provided with a lamp cap 2 and encloses an evacuated space 13, in which a discharge vessel 3 is arranged. The discharge vessel 3 is provided at each of its both ends with an electrode 4,5. In the operating condition of the lamp, a discharge takes place between the electrodes 4 and 5. The electrode 4 is connected by means of a metal strip 6 to a rigid supply conductor 7. This supply conductor 7 leads to a connection member of the lamp cap 2. The electrode 5 is also connected via a metal strip 8 to a rigid supply conductor 9, which leads to another connection member of the lamp cap 2.

Reference numeral 10 designates a closed holder, which is provided with a glass wall **10*a*. By means of wires 11, 12, which are secured to the current conductor 9, the holder is positioned. Another possibility consists in positioning the holder by means of a single wire. It is also possible to secure the positioning wires to the supply conductor 7**.

A practical case related to a high-pressure sodium lamp designed for dissipation of 70 W and to be operated at a voltage source of 220 V, 50 Hz, in conjunction with an external starter. The evacuated space 13 enclosed by the outer bulb 1 had a volume $V_b$ of 260 $10^{-6}$ $m^3$. The closed holder 10 had a volume V of 1.7 $10^{-6}$ $m^3$, a surface pervious to helium of 7.9 $10^{-4}$ $m^2$ and a wall thickness of the glass wall **10*a* of 0.9 mm. The helium filling pressure at 300K in the closed holder 10 was 7 kPa. Thus, for the closed holder the relation O v·d had a value of 5.1 $10^5$. For the lamp the relation $V/V_b$. P had a value of 47. The wall 10*a*** of the closed holder consisted of glass comprising as a glass-forming constituent $SiO_2$ in a molar fraction of 77. During operation of the lamp, the wall of the closed holder had a temperatur of about 180° C. The lamp voltage and the lamp efficiency of the lamp described have been measured several times during the life. This also holds for a lamp according to the prior art, which was proportioned accordingly. The results are stated in the table below, the values of the lamp voltage and of the efficiency being expressed in % with respect to the values with a life of 100 operating hours. Furthermore, similar results are stated of lamps designed for a dissipation of 150 W and 400 W.

TABLE

| lamp power (W) | 70 | 70 | 150 | 150 | 400 | 400 |
|---|---|---|---|---|---|---|
| closed holder with helium present | yes | no | yes | no | yes | no |
| lamp voltage after hours operating | | | | | | |
| 100 h | 100% | 100% | 100% | 100% | 100% | 100% |
| 2000 h | 92% | 96% | 86% | 95% | 94% | 99% |
| 5000 h | — | — | 80% | 100% | 89% | 101% |
| 10000 h | 121% | 141% | — | — | — | — |
| lamp efficiency after hours operating | | | | | | |
| 100 h | 100% | 100% | 100% | 100% | 100% | 100% |
| 2000 h | 90% | 93% | 99% | 99% | 99% | 98% |
| 5000 h | — | — | — | — | 97.5% | 97% |
| 10000 h | 87% | 86% | — | — | — | — |

It appears from the table that the lamp according to the invention, designed for 70 W, has an increase of the lamp voltage about 20% less than the known lamp after 10,000 operating hours. Altough none of the two lamps had reached the end of their lives, it may be expected on account of the course of the increase of the lamp voltage that the lamp according to the invention will have a life which is about 25% longer than that of the known lamp.

In the lamp according to the invention designed for 70 W, the helium pressure in the evacuated space was 0 Pa after 100 operating hours and 3.6 Pa after 10,000 operating hours. The helium pressure in the closed holder, measured at 300K, had decreased from 7 kPa after 100 operating hours to 6.2 kPa after 10,000 operating hours.

What is claimed is:

1. A high-pressure sodium discharge lamp for operation in conjunction with an internal starter without a glow discharge or with an external starter, said lamp having an outer bulb which is provided with a lamp cap and encloses an evacuated space in which a discharge vessel is arranged, characterized in that the space enclosed by the outer bulb also accommodates a closed holder, which contains at least helium and whose wall mainly comprises glass-forming constituents said holder effective for introducing said helium into said outer bulb at a rate sufficient to increase the heat transfer from said discharge vessel so that the normal increase in lamp voltage over the life of the lamp is reduced.

2. A lamp as claimed in claim 1, characterized in that the closed holder is arranged near one end of the discharge vessel.

3. A lamp as claimed in claim 2, characterized in that the wall of the closed holder comprises a molar fraction of glass-forming constituents which is at least 65 and at most 90.

4. A lamp as claimed in claim 3, characterized in that for the closed holder the following relation holds:

$$2.5\ 10^5 \leqq O/V \cdot d \leqq 10^6,$$

where

O is the area of the outer surface pervious to helium of the closed holder in $m^2$, V is the volume enclosed by the closed holder in $m^3$ and d is the thickness of the wall of the closed holder in m.

5. A lamp as claimed in claim 4, characterized in that for the lamp the following relation holds:

$$24 \leqq V/V_b \cdot P \leqq 94,$$

where

V is the volume enclosed by the closed holder in $m^3$, $V_b$ is the volume enclosed by the outer bulb in $m^3$ and P is the filling pressure of the helium in the closed holder at 300K in Pa.

6. A lamp as claimed in claim 3, characterized in that for the lamp the following relation holds:

$$24 \leqq V/V_b \cdot P \leqq 94,$$

where

V is the volume enclosed by the closed holder in $m^3$, $V_b$ is the volume enclosed by the outer bulb in $m^3$ and P is the filling pressure of the helium in the closed holder at 300K in Pa.

7. A lamp as claimed in claim 2, characterized in that for the lamp the following relation holds:

$$24 \leqq V/V_b \cdot P \leqq 94,$$

where

V is the volume enclosed by the closed holder in $m^3$, $V_b$ is the volume enclosed by the outer bulb in $m^3$ and P is the filling pressure of the helium in the closed holder at 300K in Pa.

8. A lamp as claimed in claim 2, characterized in that for the closed holder the following relation holds:

$$2.5\ 10^5 \leqq O/V \cdot d \leqq 10^6,$$

where

O is the area of the outer surface pervious to helium of the closed holder in $m^2$, V is the volume enclosed by the closed holder in $m^3$ and d is the thickness of the wall of the closed holder in m.

9. A lamp as claimed in claim 8, characterized in that for the lamp the following relation holds:

$$24 \leqq V/V_b \cdot P \leqq 94,$$

where

V is the volume enclosed by the closed holder in $m^3$, $V_b$ is the volume enclosed by the outer bulb in $m^3$ and P is the filling pressure of the helium in the closed holder at 300K in Pa.

10. A lamp as claimed in claim 1, characterized in that for the lamp the following relation holds:

$$24 \leqq V/V_b \cdot P \leqq 94,$$

where

V is the volume enclosed by the closed holder in $m^3$, $V_b$ is the volume enclosed by the outer bulb in $m^3$ and P is the filling pressure of the helium in the closed holder at 300K in Pa.

11. A lamp as claimed in claim 1, characterized in that for the closed holder the following relation holds:

$$2.5\ 10^5 O/V \cdot d \leqq 10^6,$$

where

O is the area of the outer surface pervious to helium of the closed holder in $m^2$, V is the volume enclosed by the closed holder in $m^3$ and d is the thickness of the wall of the closed holder in m.

12. A lamp as claimed in claim 11, characterized in that for the lamp the following relation holds:

$$24 \leqq V/V_b \cdot P \leqq 94,$$

where

V is the volume enclosed by the closed holder in $m^3$, $V_b$ is the volume enclosed by the outer bulb in $m^3$ and P is the filling pressure of the helium in the closed holder at 300K in Pa.

13. A lamp as claimed in claim 1, characterized in that the wall of the closed holder comprises a molar fraction of glass-forming constituents which is at least 65 and at most 90.

14. A lamp as claimed in claim 13, characterized in that for the lamp the following relation holds:

$$24 \leqq V/V_b \cdot P \leqq 94,$$

where

V is the volume enclosed by the closed holder in $m^3$,
$V_b$ is the volume enclosed by the outer bulb in $m^3$ and
P is the filling pressure of the helium in the closed holder at 300K in Pa.

15. A lamp as claimed in claim 13, characterized in that for the closed holder the following relation holds:

$$2.5\ 10^5 \leqq O/V \cdot d \leqq 10^6,$$

where

O is the area of the outer surface pervious to helium of the closed holder in $m^2$,
V is the volume enclosed by the closed holder in $m^2$ and d is the thickness of the wall of the closed holder in m.

16. A lamp as claimed in claim 5, characterized in that for the lamp the following relation holds:

$$24 \leqq V/V_b \cdot P \leqq 94,$$

where

V is the volume enclosed by the closed holder in $m^3$,
$V_b$ is the volume enclosed by the outer bulb in $m^3$ and
P is the filling pressure of the helium in the closed holder at 300K in Pa.

17. A high pressure sodium vapor discharge lamp, comprising:

(a) an outer envelope,
(b) a high pressure sodium vapor discharge device within said outer envelope, energizable for emitting light, and having a lamp voltage that normally increases with lamp life, and
(c) means for introducing a gas into said outer envelope at a rate sufficient to increase the heat transfer from said discharge device so that the normal increase in lamp voltage over the life of the lamp is reduced.

18. A lamp as claimed in claim 17, in which the gas introducing means comprises a cell, having a plurality of walls in which at least one wall is gas permeable, and which contains a gas, said cell wall being permeable to said gas for releasing said gas into the outer envelope at a rate sufficient to increase the heat transfer from said discharge device so that the normal increase in lamp voltage over the life of the lamp is reduced.

19. A lamp as claimed in claim 18, in which said cell is proximate one end of said discharge vessel for heating of said cell, said cell wall is comprised 65 to 90 molar percent of glass forming constituents, and said gas is inert.

20. A lamp as claimed in claim 19, where said cell is dimensioned such that:

$$2.5 \times 10^5 \leqq O/V \cdot d \leqq 10^6,$$

where

O is the area of the outer surface pervious to helium of said cell in $m^2$,
V is the volume enclosed by said cell in $m^3$, and
d is the thickness of the cell wall in m.

21. A lamp as claimed in claim 20, where said cell is dimensioned such that:

$$24 \leqq V/V_b \cdot P \leqq 94,$$

where

V is the volume enclosed by said cell in $m^3$,
$V_b$ is the volume enclosed by the outer envelope in $m^3$, and
P is the filling pressure of said gas in the cell at 300° K. in Pa.

22. A lamp as claimed in claim 21, wherein said inert gas is comprised of helium.

23. A lamp as claimed in claim 19, where said cell is dimensioned such that:

$$24 \leqq V/V_b \cdot P \leqq 94,$$

where

V is the volume enclosed by said cell in $m^3$,
$V_b$ is the volume enclosed by the outer envelope in $m^3$, and
P is the filling pressure of said gas in the cell at 300° K. in Pa.

* * * * *